United States Patent [19]

Kirner et al.

[11] Patent Number: 5,064,691

[45] Date of Patent: Nov. 12, 1991

[54] GAS PHASE BOROSILICONIZATION OF FERROUS SURFACES

[75] Inventors: John F. Kirner, Orefield; Alejandro L. Cabrera, Fogelsville; John N. Armor, Orefield, all of Pa.

[73] Assignee: Air Products and Chemicals, Inc., Allentown, Pa.

[21] Appl. No.: 488,541

[22] Filed: Mar. 2, 1990

[51] Int. Cl.[5] ..... C23C 8/06; C23C 8/28; C23C 16/30; C23C 16/46

[52] U.S. Cl. ..... 427/252; 427/250; 427/253; 427/255.1; 427/255.2; 427/255.4; 148/279

[58] Field of Search ..... 148/279; 427/250, 252, 427/253, 255.1, 255.2, 255.4

[56] References Cited

U.S. PATENT DOCUMENTS

| | | | |
|---|---|---|---|
| 2,494,267 | 1/1950 | Schlesinger et al. | 148/279 |
| 2,823,151 | 2/1958 | Yntema et al. | 148/279 |
| 2,920,006 | 1/1960 | Yntema et al. | 148/279 |
| 4,714,632 | 12/1987 | Cabrera et al. | 427/255 |
| 4,822,642 | 4/1989 | Cabrera et al. | 427/255.1 |

FOREIGN PATENT DOCUMENTS

| | | | |
|---|---|---|---|
| 748396 | 5/1956 | United Kingdom | 148/279 |
| 1511353 | 5/1978 | United Kingdom . | |

OTHER PUBLICATIONS

Samsonov et al, *Coatings of High-Temp. Materials*, (Plenum Press, N.Y.) c. 1966, pp. 1-33.

"The Properties of a Chemical Vapour-Deposited Silicon Base Coating ro Gas Turbine Bloding", Thin Solid Films, A. R. Nicoll, et al, vol. 64, (1979), pp. 321-326.

"Engineering the Surface with Born Based Materials", Surface Engineering, P. A. Deanley et al, vol. 1, (1985) pp. 203-217.

"Influence of $AsH_3$, $PH_3$, and $B_2H_6$m the Growth Rate and Resistivity of Poly-cryptalline Silicon-Films Deposited from a $SiH_4$—$H_2$ Mixture," J. Electrochem, F. E. Lverdeyn et al, vol. 120, )973) pp. 106-110.

"Born Doping Effect on Silicon Film Deposition in the $Si_2H_6$—$B_1H_6$—He Gas System", Q. Metrochem, S. Nakayama et al, vol. 133, No. 8 (1986) pp. 1721-1724.

*Primary Examiner*—Shrive Beck
*Assistant Examiner*—Margaret Burke
*Attorney, Agent, or Firm*—Mark L. Rodgers; William F. Marsh; James C. Simmons

[57] ABSTRACT

The surface properties of iron or ferrous alloy are improved by borosiliconizing the surface by contact with a stream of reducing gas containing hydrogen, optionally with an inert gas, to which a gaseous halide or hydride of boron and silicon have been added, either together or sequentially. The temperature of treatment is elevated, e.g. above 350° C., but below 1200° C. Diffusion coatings of both boron and silicon are formed in the ferrous surface. Typical surces of boron and silicon inlude boron trichloride, diborane and silane.

5 Claims, 6 Drawing Sheets

GAS PHASE BOROSILICONIZATION OF FERROUS SURFACES

FIELD OF INVENTION

This invention relates to a method of improving the properties of a surface of iron or ferrous alloy by gas phase borosiliconization. In another aspect it relates to a method of protecting the surface of a ferrous alloy from oxidative attack and erosion by borosiliconizing the surface.

BACKGROUND OF THE INVENTION

Although iron and ferrous alloys provide good structural mechanical properties such as strength and toughness, they are frequently deficient in their surface characteristics such as hardness and resistance to oxidative attack. Protective coatings are applied to overcome these surface deficiencies. For example, boron can be added in a diffusion coating to improve the wear resistance of carbon steels. Silicon is applied in a diffusion coating to improve corrosion and high temperature oxidation resistance of ferrous alloys.

It has been known for several decades that steels and high alloy steels can be borided by using a mixture of diborane and hydrogen at temperatures of 550° to 950° C. Iron, steel, nickel and cobalt surfaces can be hardened in this manner by producing a metal boride layer as thin as 5 microns, although boronized layers having thicknesses as high as 20 to 200 microns and containing FeB and $Fe_2B$ are known. Another method of gas phase boriding of steels is by the use of $BCl_3$ in gas mixture with hydrogen and nitrogen using similar temperatures of about 550° to 950° C. $BCl_3$ and hydrogen can be used to boronize steels to produce a boronized layer having a thickness of 50 to 250 microns.

The use of silicon and boron together to form a protective oxide coating on a metal surface is described by British Patent 1,511,353 (1978). This patent describes forming a protective coating of 20 to 85 wt % silicon oxide and 80 to 15 wt % boron oxide on a metal surface by passing over the surface which has been heated between 300° and 1500° C. a gas mixture of silane, diborane, oxygen and an inert carrier gas, the temperature of the gas being at least 50° C. below that of the surface. The oxide coatings are said to provide improved corrosion resistance, but are limited to operating temperatures below 1500° C.

Nicoll, et al., *Thin Solid Films*, vol. 64, pages 321-326 (1979) discloses the addition of boron to silicon diffusion coating on nickel-base superalloys using chemical vapor deposition in which the chemical vapor is hydrogen containing both silicon tetrachloride and borontrichloride in a single treatment. The presence of boron is said to improve mechanical properties of the coating.

A review of the state of the art regarding boron surface treatment of metals and engineering alloys in order to increase surface hardness is given by Dearnley, et al., *Surface Engineering*, vol. 1, pages 203-217 (1985). Boriding is said to be unsuited for high alloy steels because FeB formation results in a thin, poorly adherent boride layer. Steels containing large quantities of silicon are said to be unsuited to boriding because of the formation of a ferrite stabilized region, adjacent the boride layer, which remains soft. Several boriding techniques are described. Packed boriding, the most favored method for safety and simplicity, involves embedding the component to be treated in a boriding powder such as $B_4C$.

Inert diluents include silicon carbide or aluminum oxide. Paste boriding is another technique in which $B_4C$ suspension in a binder is coated on the component. Liquid phase boriding using a salt bath, e.g. $Na_2B_4O_7$, can be either electroless or electrolytic. Gas phase boriding can be carried out by thermal decomposition of diborane or by the reduction of boron chloride with hydrogen, optionally diluted with nitrogen to reduce FeB production. Plasma phase boriding is yet another possible technique. Multicomponent boriding is said to have been accomplished by electrolytic salt bath and paste techniques, but most interest has been focused on the pack methods. Borosiliconizing is said to be accomplished using the pack technique to boride a steel substrate and then siliconize it at 900° to 1000° C., resulting in the formation of FeSi in the layer which helps corrosion-fatique endurance. Chemical vapor deposition, CVD, by gas phase treatment is not suggested for boron siliconizing but is described for deposition of metal borides, e.g. WB, $ZrB_2$ and $TiB_2$. CVD of boron from hydrogen/boron trichloride gas mixtures is described at temperatures of about 1050° to 1250° C. and is said to depend on substrate temperature, supersaturation of gaseous reaction product in the gas in equilibrium with the substrate, gas flow conditions and treatment time.

Commercially, Boroloy Industries' C-1 coating system is a boron silicide diffusion coating prepared using pack cementation.

In the semiconductor industry, boron has been used to improve the formation of silicon layers on silicon wafer substrates. Eversteyn, et al., *J. Electrochem.*, vol. 120, pages 106-110 (1973) disclose that the deposition rate of silicon films from $SiH_4$ gas systems can be doubled by the addition of $B_2H_6$. The polycrystalline silicon layers deposited in the presence of $B_2H_6$ are said to have a denser structure compared to undoped growth. Nakayama, et al, *J. Electrochem.*, vol. 133, pages 1721-1724 (1986) disclose that deposition rates of silicon on silicon wafer substrates by CVD using $Si_2H_6$ in helium can be increased by the addition of $B_2H_6$ to the gas system.

Improvements in the method of forming silicon diffusion coatings are disclosed by our U.S. Pat. No. 4,714,632, Cabrera, et al. (1987) which describes producing silicon diffusion coatings on a metal surface (such as iron and ferrous alloys) using silane, either alone or diluted with hydrogen. The coatings are formed at temperatures below 1000° C. The metal surface is pretreated with a reducing atmosphere, such as hydrogen. Surface silicon can subsequently be oxidized to silicon dioxide to provide oxidation protection. U.S. Pat. No. 4,822,642, Cabrera, et al. (1989) describes similarly forming silicon diffusion coatings on the surfaces of nonferrous metals at temperatures below 1200° C.

While silicon diffusion coating improve the resistance of iron or ferrous alloy surface to oxidation, carburization, sulfidation and corrosion, a tendency of mechanical failure has limited the coating life. For example, in oxidizing environments, the coatings tend to crack and become undermined by oxidation of the underlying metallic substrate. Boriding should further improve resistance to wear and galling, provide some corrosion resistance to the metal, and improve mechanical properties of the coating. Although pack cementation methods which have been used to borosiliconize steel are safe and simple, it is desired to obtain better control of the ratios of the diffusion elements and thereby better control over the composition of the diffusion coating.

BRIEF SUMMARY OF THE INVENTION

We have found an effective method for borosiliconizing iron or ferrous alloy surfaces to develop diffusion coatings with good control of the diffusing elements and the coating composition. According to our invention, the surface properties of a structure formed from iron or a ferrous alloy are improved by subjecting the surface of the structure to a stream of reducing carrier gas made up of hydrogen, optionally with an inert gas such as nitrogen, to which has also been added a gaseous hydride or halide compound of each of silicon and boron. The silicon and boron compounds can be added together or sequentially and the borosiliconization takes place at an elevated temperature below 1200° C. for a time sufficient to diffuse both the silicon and boron into the metal surface. Our invention is particularly attractive as a method of protecting the surface of a ferrous alloy from oxidative attack by borosiliconizing the surface by first exposing the surface to an atmosphere of hydrogen and either a boron hydride or a boron halide and inert gas at a temperature of about 400°-800° C. when a boron hydride is used and 500°-1200° C. when a boron halide is used. The boriding is carried out for a time sufficient to form a boron diffusion coating in the ferrous alloy surface and thereafter the surface is exposed to an atmosphere of hydrogen, inert gas and a silicon hydride at a temperature of 350°-1000° C. for a time sufficient to form a silicon diffusion coating in the ferrous surface.

DETAILED DESCRIPTION OF THE INVENTION

Figure 1:
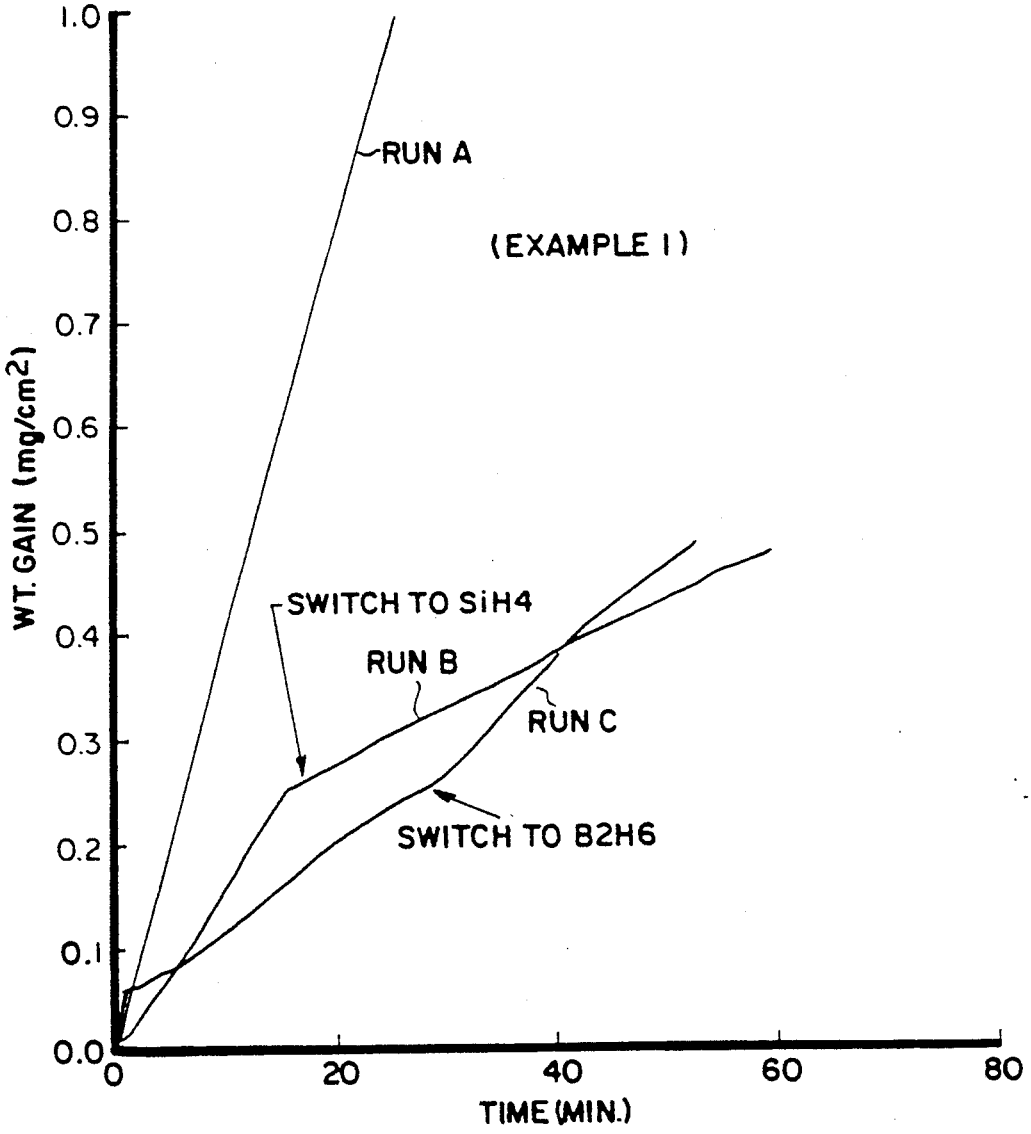
FIG. 1 is a plot of weight gain over time during three borosiliconization procedures given in Example 1.

The surface properties of iron or ferrous alloy are improved according to the invention by borosiliconizing the metal surface to form mixed boron and silicon diffusion coatings. The method used is a gas phase treatment at temperatures below 1200° C., preferably 550°-1000° C. The boriding and siliconizing can be carried out simultaneously or sequentially, for example by first boriding followed by siliconizing or by siliconizing the surface followed by boriding.

The metal substrates which are treated according to our invention are iron and ferrous alloys, either wrought or cast, such as low carbon steel, mild steel, low alloy steel, chromium steel, austenitic, ferritic and other stainless steels and the like.

The sources of silicon and boron can be any gaseous molecule of a silicon or boron hydride or halide such as $SiH_4$, $SiCl_4$, $Si_2H_6$, $Si_2Cl_6$, $SiH_nX_{4-n}$ (X=halogen, n=0 to 3) $B_2H_6$, $BCl_3$, and the like. These gases are diluted with hydrogen or a mixture of hydrogen and one or more inert gases such as nitrogen, argon or helium. If the volatile source of silicon or boron in the first treatment step contains no halogen, the process also includes a pretreatment step under a reducing atmosphere, preferably hydrogen, which is controlled so that the quantity of oxygen atoms present in the gas insures that the substrate is devoid of any barrier oxide coatings. The preferred method is boriding the surface using $BCl_3$ diluted with hydrogen and nitrogen followed by siliconizing using $SiH_4$ diluted with hydrogen. In this manner, the boride layer promotes the formation of a dense, crack-free silicide and also provides a fluxing action which promotes the formation of a protective oxide layer.

The pretreatment of the metal surface to reduce or prevent the formation of any oxide film which could act as a barrier to the diffusion coating is preferably used in all instances but is required if, as pointed out above, the initial source of boron or silicon in the first step of the diffusion coating process contains no halogen. If the volatile source of silicon or boron contains halogen, for example in silicon tetrachloride or boron trichloride, the pretreatment is less important because of the potential fluxing ability of the acid produced in the hydrogen reduction of the silicon or boron source.

The pretreatment temperature is in the range of 400°-1200° C. and the higher temperatures in this range are favored both for thermodynamic and kinetic reasons. For example, it is preferred to operate at about 500°-900° C. in the pretreatment and the temperature chosen will be based upon the mechanical properties of the substrate. The pretreatment should be carried out for whatever time is required to clean the surface. Although it is preferred to operate at atmospheric pressure, the pressure can vary over a broad range with the maximum pressure of the hydrogen being that at which embrittlement of the substrate becomes a problem. The minimum hydrogen pressure will be determined by whatever minimum partial pressure of oxygen is attainable, for it is desired to operate with the oxygen to hydrogen molar ratio at a value which is typically less than $2\times10^{-4}$. In considering the molar oxygen content, all sources of oxygen (e.g. water vapor, gaseous oxygen, carbon dioxide or other oxygen donors) must be taken into account, with water being the primary source. This ratio is controlled so that the atmosphere is reducing to the metal substrate at the temperature of pretreatment. The ratio of any oxygen present to the inert gas is the minimum to obtain the desired oxygen to hydrogen ratio.

In the gas phase diffusion coating treatment the temperature should be below 1200° C. but must be at an elevated temperature, for example at least 350° C. The temperature selected will depend upon the boron or silicon hydride or halide selected as a source of boron and silicon. For example, when using diborane, a temperature of 400°-800° C. works well and a temperature of 500°-1200° C. can be used when using boron trichloride. On the other hand, the temperature should be about 350°-1000° C. for silicon tetrahydride.

In the formation of the diffusion coating, if the volatile source of silicon or boron contains no halogen, the atmosphere must be controlled to prevent formation of any oxide film which could act as a barrier coating. For example, the molar ratio of the source of silicon or boron to oxygen must be greater than 2.5. Also when using a silicon or boron source which contains no halogen, the process is typically performed at the lower temperatures, preferably 550°-650° C. for diborane and 600°-750° C. for silane. When diborane is used, a flow rate which provides a linear velocity greater than 25 cm/sec is desired. If the volatile source of the silicon or boron contains a halide, the process is performed at higher temperatures, preferably at 700°-850° C. for boron trichloride. The carrier gas is hydrogen with or without an inert gas such as argon, helium or nitrogen.

The concentration of the boron or silicon compound in the treating gas can vary from as little as one part per million to 100% of the treating gas, although when the compound is a halide, sufficient hydrogen should be present to reduce the halide. Preferably the concentration of diborane is from 0.01 to 0.1 mole % while that of boron trichloride is 0.05-5 mole %, and even more preferably 0.1-1 mole %. The concentration of silane is preferably 0.05-5 and more preferably 0.1-0.5 mole % of the treating mixture. The ratio of hydrogen to inert gas, preferably nitrogen, can likewise vary over a broad range, but a practical operational level is a molar ratio of 25/75 for $H_2/N_2$.

The treatment time can take place in as short as one minute and can run to as long as 48 hours if desired, but preferably the treatment will be complete in about 5-120 minutes. The coating thickness is limited only so that a substantial portion of the deposited element, either silicon or boron, is present as a diffusion coating and not only as an overlay coating. The presence of a diffusion coating as contrasted to an overlay coating can be determined by the surface examination methods described in the examples, such as Auger Electron Spectroscopy (AES) and SEM/EDAX analysis of cross-sectioned samples.

Although it is preferred to operate at atmospheric pressure, the borosiliconizing steps can actually be carried out at subatmospheric pressure, for example, $1\times10^{-3}$ Torr, up to that pressure at which hydrogen embrittlement of the substrate becomes significant. The flow rate of the treating gas is dependent upon the configuration of the metal structure being surface treated and the treatment chamber, but can be regulated as required to obtain a uniform deposition of the silicon and boron as a diffusion coating over the entire surface desired to be treated. For deposition of boron from diborane in a hot wall reactor, linear velocities greater than 25 cm/s is required.

In order to demonstrate our invention further, the following examples are presented to be illustrative only and should not be construed to limit our invention unduly.

GENERAL PROCEDURE OF EXAMPLES

Metal coupons were suspended by a quartz wire from a Cahn 1000 recording microbalance inside an 18 mm i.d. quartz flow-through hangdown tube. Each coupon was heated with a split tube furnace, the temperature being measured using a type K thermocouple inserted in a quartz thermowell situated approximately 1 cm below the coupon. Gases were controlled using mass flow controllers; all flows are reported at STP (0° C., 101 kPa). $BCl_3$ was used as a liquefied gas in a lecture bottle. It has a slight vapor pressure of 30.3 kPa (4.4 psig) at 21.1° C., sufficient to feed it as a gas and control it using a mass flow controller.

Coupons of metal alloys with a glass bead surface finish were obtained from Metal Samples Co. Gases were Air Products and Chemicals Research Grade hydrogen, 0.5% $SiH_4/H_2$, 0.5% $B_2H_6/H_2$ and argon; Electronic Grade boron trichloride; Zero Grade compressed air; and House nitrogen.

Coupons were washed in a methanol sonic bath for about 15 minutes, and suspended from the balance using a quartz hangdown wire. The system was evacuated, refilled, and purged with dry $N_2$.

For the $B_2H_6$ treatment, the coupon was heated in flowing dry $H_2/N_2$ to 800° C., and pretreated for 0.5 hour to remove surface impurities. It was then cooled to the treatment temperature and $B_2H_6$ and/or $SiH_4$ admitted by blending in premixed 0.5% $B_2H_6/H_2$ or 0.5% $SiH_4/H_2$ in an amount to obtain the desired concentration. Weight was monitored for the desired period of time, then the $B_2H_6/SiH_4/H_2$ flow was diverted. For the consecutive treatments, the hangdown tube was purged for several minutes with $H_2/N_2$ between treatments at the treating temperature. After completing the treatment, the furnace was turned off, and the coupon was cooled under flowing $H_2$.

For the consecutive treatments using $BCl_3$ and $SiH_4$, the coupon was heated to the treatment temperature in dry $N_2$ flowing at 2.36 L/min. The flow was switched to 28% $H_2$/72% $N_2$ at 2.36 L/min, and the coupon pretreated for 0.5 hour to remove surface impurities. During the pretreatment, $BCl_3$, at the appropriate flow, was blended with $N_2$ to give a total flow of 0.28 L/min. The $BCl_3/N_2$ blend was purged for 0.5 hour at 0.28 L/min prior to admitting it to the hangdown tube. $BCl_3$ was then admitted by blending the $BCl_3/N_2$ stream into the $H_2/N_2$ stream to obtain a total gas composition of approximately 25% $H_2$/75% $N_2$ at a flow of 2.64 L/min. Weight was monitored for the desired period of time, then the $BCl_3/N_2$ flow was diverted and the $H_2$ flow was switched to $N_2$. Then the coupon was cooled to the siliconizing temperature in flowing $N_2$ in case the tube broke from stresses caused by deposited boron. The coupon was then treated in 0.1% $SiH_4/H_2$ flowing at 2.7 L/min at the siliconizing temperature. After the desired period of time, the furnace was turned off, and the coupon was cooled under flowing $N_2$.

Oxidation tests were performed using another microbalance. The coupon was hung on a quartz wire from the balance and heated in flowing dry Zero Grade compressed air to 650° C. The weight vs. time plot begins at the point where the sample first begins to gain weight.

Depth profiles were performed using AES with argon ion sputtering. Samples for metallographic analyses were cut, mounted in a cold-setting epoxy resin, and polished. Scanning electron microscopy (SEM) and Energy dispersive X-ray spectrometry (EDS) were performed on the cross-sectioned samples. X-ray diffraction (XRD) patterns were used to manually identify the phase by comparison to published standards.

EXAMPLE 1

Three runs were made to demonstrate the feasibility of borosiliconizing 1010 steel using $B_2H_6$ and $SiH_4$: $SiH_4$ and $B_2H_6$ in $H_2$ simultaneously, $B_2H_6/H_2$ first then $SiH_4/H_2$, and $SiH_4/H_2$ first then $B_2H_6/H_2$. Concentrations of 0.02% $B_2H_6$ and 0.1% $SiH_4$ were used to obtain a Si-rich coating. A temperature of 625° C. was used to facilitate Si diffusion, while maintaining as low a temperature as possible for decomposition of $B_2H_6$. Treatments were stopped at a time estimated to prevent deposition of elemental B and Si. Table I lists the treatment conditions.

TABLE I

| run | pre-treatment | time, min | 0.5% $SiH_4/H_2$, L/min | 0.5% $B_2H_6/H_2$, L/min | $H_2$, L/min | $N_2$, L/min | wt gain, mg/cm$^2$ |
|---|---|---|---|---|---|---|---|
| A | $H_2/N_2$, 800° C. | 25 | 0.74 | 0.16 | 1.00 | 2 | 0.99 |
| B | $H_2/N_2$, 625° C. | 16 | — | 0.16 | 1.74 | 2 | 0.26 |
| (step 2) | — | 44 | 0.74 | — | 1.16 | 2 | 0.23 |
| C | $H_2/N_2$, 625° C. | 27 | 0.74 | — | 1.16 | 2 | 0.24 |
| (step 2) | — | 25 | — | 0.16 | 1.74 | 2 | 0.25 |

Figure 2:
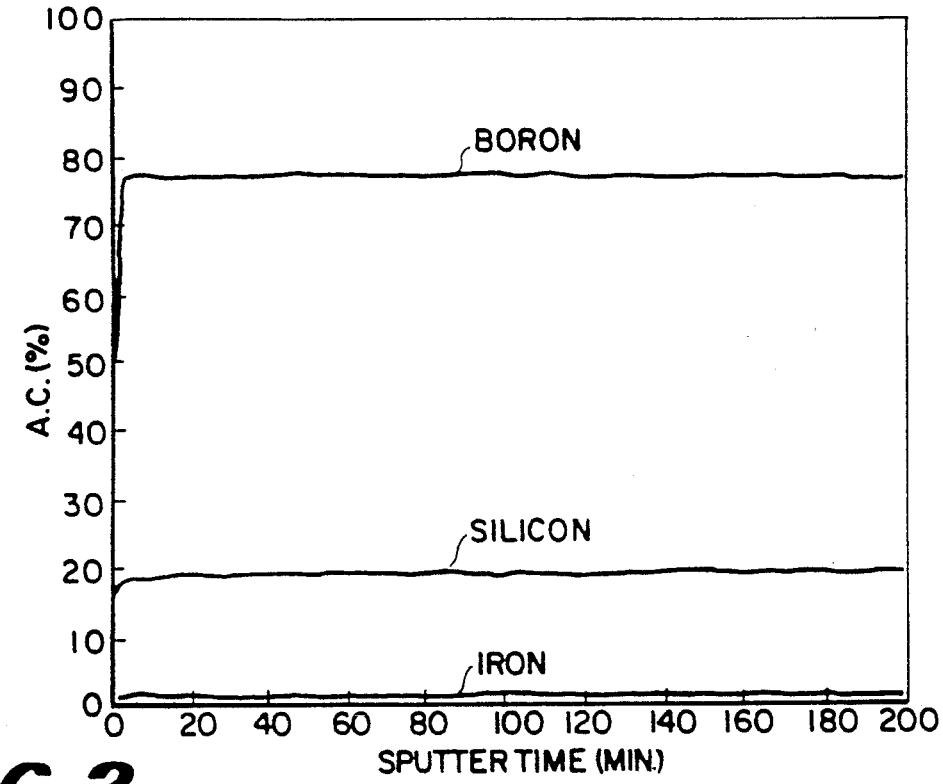
FIGS. 2, 3, 4, and 5 are Auger Electron Spectroscopy (AES) depth profiles of the compositions (A.C.=atomic concentrations) of treated steel surfaces described in Example 1.

FIG. 1 compares the weight gain vs. time plots for the three runs. Unexpectedly, there appears to be a synergistic effect of $B_2H_6$ and $SiH_4$, since weight gain for the simultaneous deposition was faster than the sum of the weight gains observed for $SiH_4$ and $B_2H_6$ separately. The three coupons were analyzed using Auger depth profiling. Profiles for two areas of the coupon of Run A are displayed in FIGS. 2 and 3 with a sputter rate of 13.5 mm/min; Profiles for the coupons of Runs B and C are displayed in FIGS. 4 and 5 with a sputter rate of 14 mm/min.

The coupon of Run A displayed a slight yellow to tan hue, and there were small shiny silver regions raised above the surface that appeared to be flaking off. A raised region consisted of an overlay coating containing B and Si in a ratio of Si:B=1:4 for the entire profile of 2.7 μm (See FIG. 2). Thus the raised regions appeared to be isolated islands of a poorly adherent borosilicon overlay coating.

Figure 3:
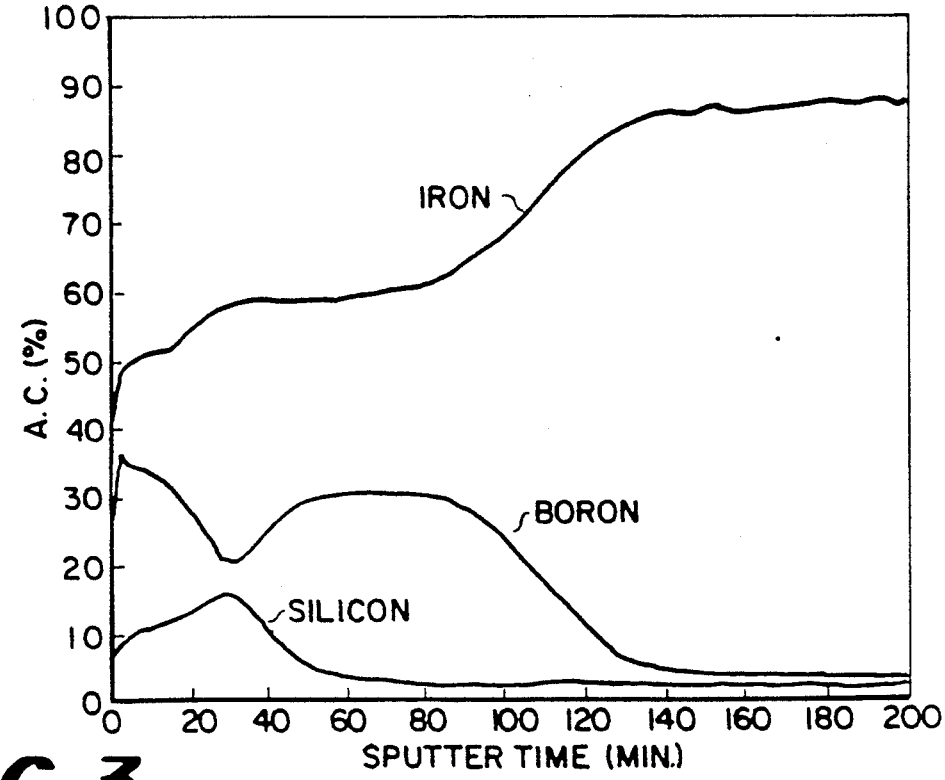

The surrounding coating consisted of a diffusion layer, with an Fe concentration of 50 to 60 atom %, that contained two zones. The outer zone was about 0.7 μm thick and contained both diffused Si and B; the inner zone was about 0.7 μm thick and contained only diffused B. The initial Si:B ratio of 1:3.5 in the outer zone was similar to the ratio for the overlay. The Fe:B ratio in the inner zone was 2, consistent with the formation of $Fe_2B$. FIG. 3 shows the depth profile for the surrounding coating.

Figure 4:
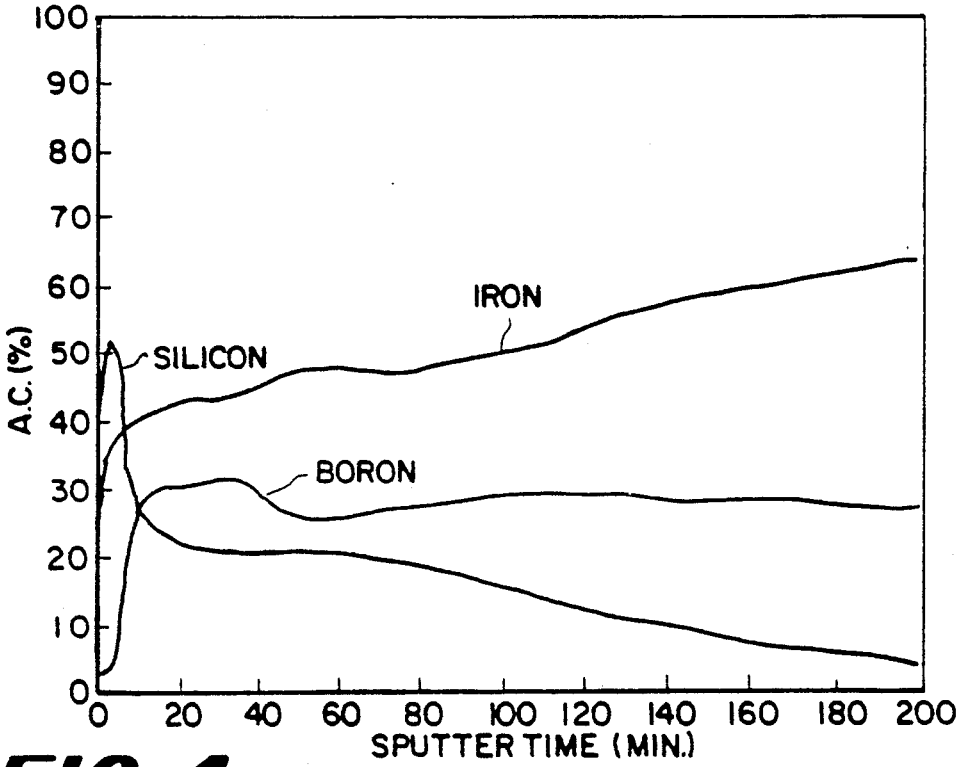

The coating on the coupon of Run B, which was treated with $B_2H_6$ first and then $SiH_4$, displayed a rainbow appearance from interference patterns. FIG. 4 displays the Auger depth profile for Run B. This coupon had the best coating of the three treatments. There was a thin 56 nm thick Si-rich silicide region at the surface. Beneath this region, the B concentration stayed relatively constant at about 30 atom % for 2.8 μm, at which point the sputtering was discontinued. Si was also present with B beneath the silicide-rich region. Si was present at a relatively constant concentration of about 20 atom % to a depth of about 0.84 μm, then dropped off gradually. At the point at which sputtering was discontinued, there was very little Si present in the coating (whereas the B concentration was still about 30 atom %).

Figure 5:
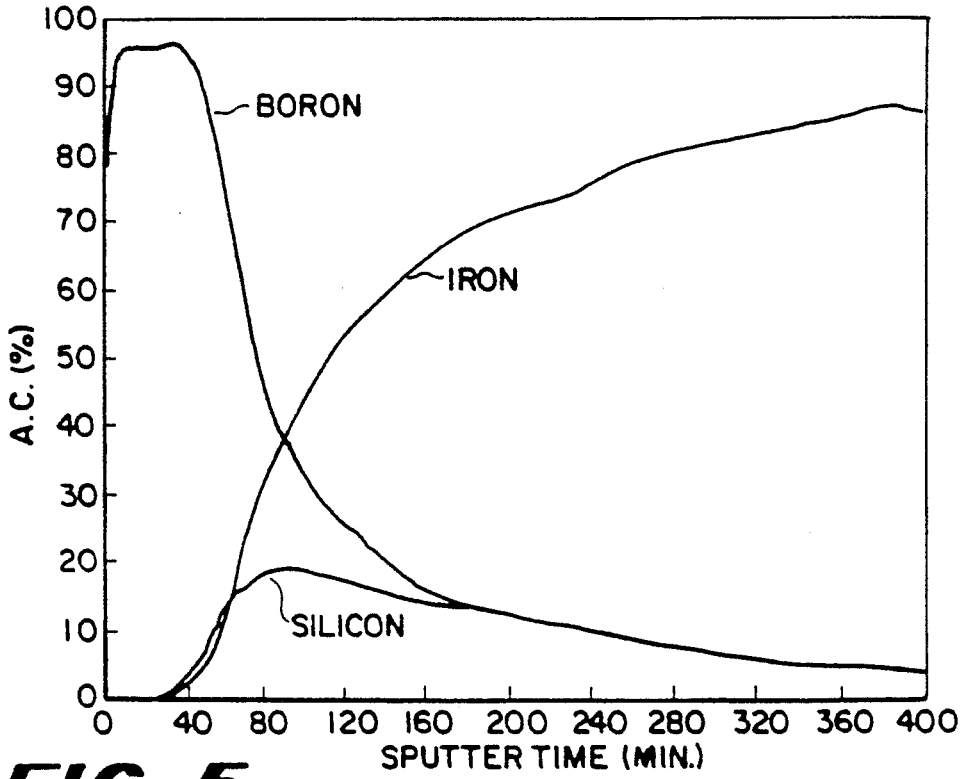

The coating on the coupon of Run C, which was treated with $SiH_4$ first and then $B_2H_6$, was fairly uniform, but small pieces were flaking off in places. FIG. 5 displays the depth profile. There was an elemental B overlay. Beneath the overlay was an extensive region of diffused Si and B, with somewhat lower Si and B concentrations than observed for Run B. For about 1.4 μm the B concentration dropped to about 15 atom %, and the Si concentration built rapidly to about 20 atom % and then also dropped to about 15 atom %. Over the next 2.8 μm both Si and B concentrations dropped gradually to less than 5 atom %.

The borosiliconized coupons were also analyzed by XRD. The coupon of Run A, which was borosiliconized simultaneously, had strong phases of bcc Fe, FeSi, and possibly $Fe_3Si$. FeB and $Fe_2B$ were possible low minor phases. The coupon of Run B, boronized first, had strong phases of bcc Fe and $Fe_2B$ oriented on [001]. FeB was a weak phase, and FeSi was a very weak possible phase. Based on the Auger depth profile, a mixture of FeB and FeSi is expected in the thin layer near the surface, and $Fe_2B$ in a thicker layer further in. The coupon of Run C, siliconized first, had strong phases of bcc Fe and FeSi. FeB was a weak phase, and $Fe_2B$ was a very weak possible phase. The intensities of the patterns from the boron-containing phases are weak because most of the boron resided on the surface as an amorphous elemental boron overlay coating. (See FIG. 5).

In summary, this example demonstrated three types of processes for borosiliconizing 1010 steel using $B_2H_6$ and $SiH_4$ diluted in $H_2$: $SiH_4$ and $B_2H_6$ in $H_2$ simultaneously, $B_2H_6/H_2$ first and then $SiH_4/H_2$, and $SiH_4/H_2$ first then $B_2H_6/H_2$. All three processes gave diffusion zones of both B and Si.

EXAMPLE 2

Since $BCl_3$ appeared to be a better boronizing agent than $B_2H_6$ because of its lower tendency to deposit elemental B, and the B/Si consecutive step borosiliconizing process appeared to work best for $B_2H_6/SiH_4$, coupons of 1010 steel were borosiliconized using consecutive treatments of $BCl_3$ and then $SiH_4$. Coupons were borosiliconized to produce coatings with high B:Si ratios for wear applications (Runs A to C) and with low B:Si ratios for high temperature applications (Runs D to H). Coupons were boronized in 0.5% $BCl_3$/25% $H_2$/75% $N_2$ at 700° or 850° C. and siliconized in 0.1% $SiH_4/H_2$ at 625° or 700° C. Table II lists the run conditions including feed rates. The $BCl_3$ feed rate is given in cubic centimeters per minute (cc/min.).

TABLE II

| run | pre-treatment | temp, °C. | time, min | 0.5% $SiH_4/H_2$, L/min | $BCl_3$, cc/min | $H_2$, L/min | $N_2$, L/min | wt gain mg/cm$^2$ |
|---|---|---|---|---|---|---|---|---|
| A | $H_2$, 850° C. | 850 | 11 | — | 13 | 0.67 | 1.98 | 1.23 |
| | $H_2$, 625° C. | 625 | 34 | 0.57 | — | 2.17 | — | 0.24 |
| B | $H_2$, 850° C. | 850 | 10 | — | 13 | 0.67 | 1.98 | 1.24 |
| | $H_2$, 700° C. | 700 | 3 | 0.52 | — | 2.17 | — | 0.26 |
| C | $H_2$, 700° C. | 700 | 53 | — | 13 | 0.67 | 1.98 | 1.24 |
| | | 700 | 5 | 0.52 | — | 0.67 | 1.50 | 0.25 |
| D | $H_2$, 700° C. | 700 | 53 | — | 13 | 0.67 | 1.98 | 0.28 |
| | | 700 | 9 | 0.52 | — | 0.67 | 1.50 | 0.74 |
| E | $H_2$, 850° C. | 850 | 1 | — | 13 | 0.67 | 1.98 | 0.24 |

TABLE II-continued

| run | pre-treatment | temp, °C. | time, min | 0.5% $SiH_4/H_2$, L/min | $BCl_3$, cc/min | $H_2$, L/min | $N_2$, L/min | wt gain mg/cm$^2$ |
|---|---|---|---|---|---|---|---|---|
| | | 700 | 11 | 0.52 | — | 0.67 | 1.50 | 0.74 |
| F | $H_2$, 850° C. | 850 | 2 | — | 13 | 0.67 | 1.98 | 0.25 |
| | | 700 | 12 | 0.52 | 13 | 0.67 | 1.98 | 0.73 |
| G | $H_2$, 850° C. | 850 | 2 | 0.52 | 13 | 0.67 | 1.98 | 0.27 |
| | | 700 | 19 | 0.52 | 13 | 0.67 | 1.50 | 0.74 |
| H | $H_2$, 850° C. | 850 | 2 | — | 13 | 0.67 | 1.98 | 0.26 |
| | | 700 | 55 | 0.52 | — | 0.67 | 1.50 | 2.47 |

Borosiliconized coupons were analyzed to determine coating morphology and composition. To speed the analyses, the samples were cut in half. The coupons were cut using a diamond saw lubricated with cutting oil, and washed with hexane in a sonic bath. The top half was used for AES depth profiling of the surface. The bottom half was mounted in a cold-setting epoxy resin for cross-sectional analysis.

Figure 6:
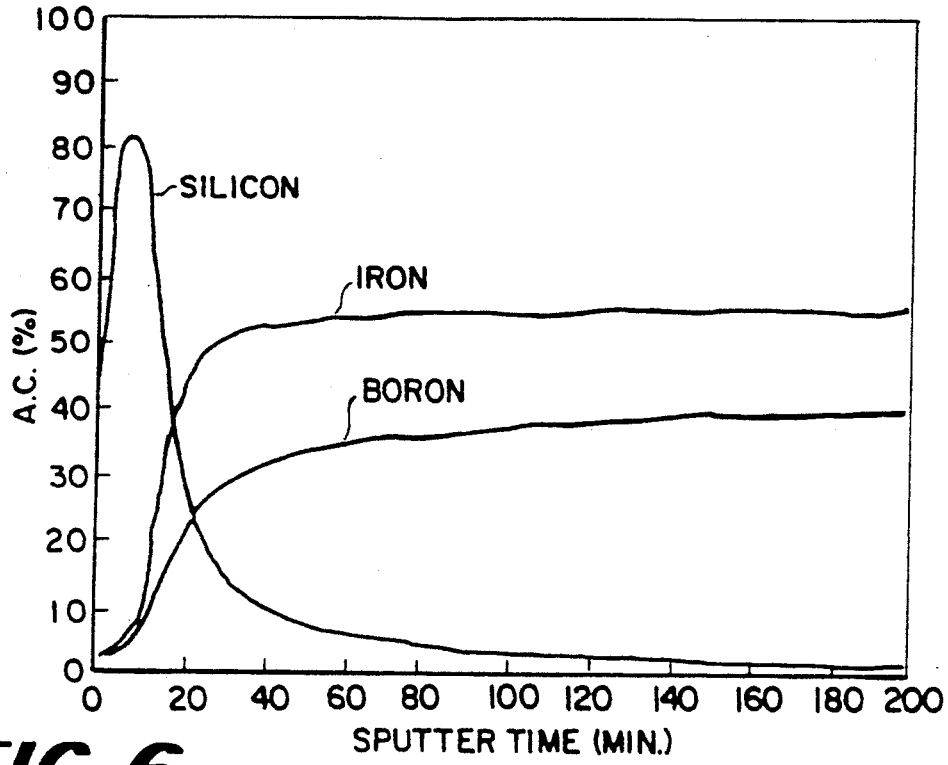
FIGS. 6, 7, and 8 are AES depth profiles of the compositions of treated steel surfaces described in Example 2.
Figure 7:
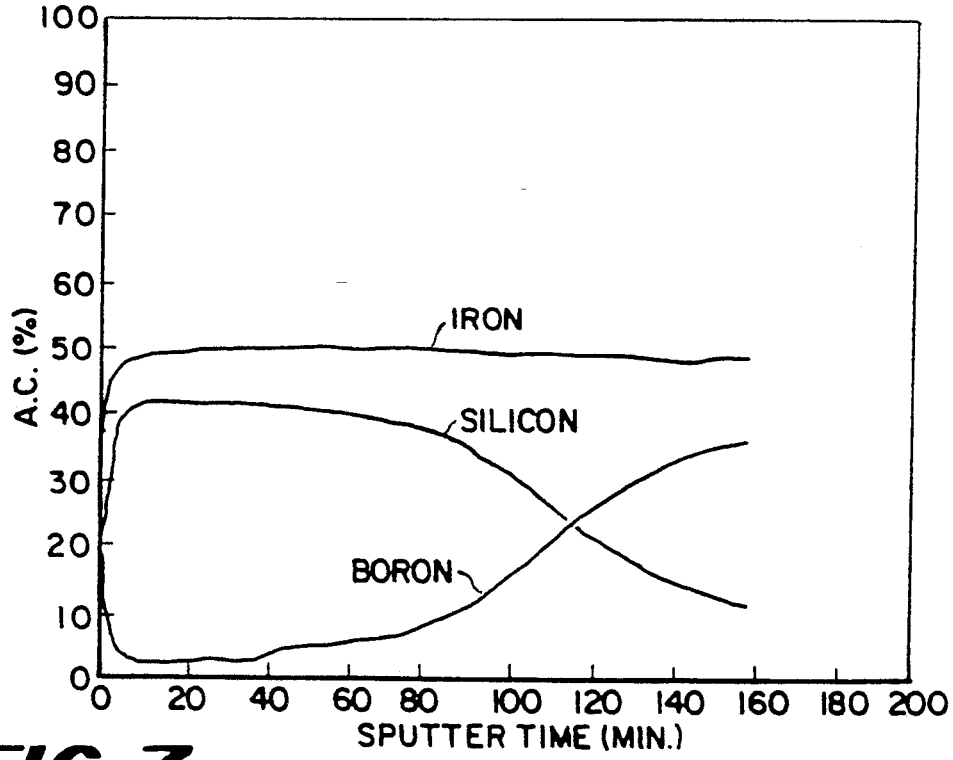

Coupons of 1010 steel borosiliconized to give high B:Si ratios (1.2 mg B/cm$^2$, 0.24 mg Si/cm$^2$) were analyzed using AES depth profiling, sputter rate of 9 nm/min. The coupon of Run A was boronized at 850° C. and siliconized at 625° C.; the coupon of Run B was boronized at 850° C. and siliconized at 700° C. FIG. 6 displays the depth profile for Run A; FIG. 7, for Run B.

Coupon A contained four zones: an elemental Si overlay, an iron silicide diffusion zone, a diffusion zone containing Fe, Si, and B (Si and B each greater than 10 atom %), and a thick iron boride diffusion layer with an Fe:B ratio of about 1.6:1. The Si, Fe/Si, and Fe/Si/B zones were 70, 25, and 220 μm thick, respectively.

Coupon B, the borosiliconized coupon siliconized at the higher temperature (700° C. vs. 625° C.), did not have an elemental Si overlay. It had a 0.7 μm-thick iron silicide layer with a constant Fe:Si ratio of about 1.2. Over the next 0.7 μm, the Si concentration gradually decreased and the B concentration gradually increased to give an Fe:B ratio of about 1.3. Si diffused at least 1.8 μm into the boride layer, where it was present at a concentration of several percent.

Thus AES depth profiling showed that treating a boronized 1010 steel (1.2 mg B/cm$^2$) with $SiH_4$ to deposit 0.24 mg Si/cm$^2$ gave a diffusion layer containing B and Si over the iron boride layer. When the siliconizing was performed at 625° C., a large portion of the Si deposited was present in an elemental Si overlay on top of the Fe/Si/B diffusion layer. When the siliconizing was performed at 700° C., Fe diffused out of the boride to form an iron silicide layer over the Fe/Si/B diffusion layer. At 700° C., a small amount of Si also diffused into the boride layer to give a Si concentration of several percent at a depth of 1.7 μm.

The coupons were also cross-sectioned and analyzed using SEM, forming secondary electron images of cross sections of the coatings on coupons A and B. The dense part of the boride coating was about 10 μm thick. Fingers of $Fe_2B$ penetrated into the substrate up to an additional 10 μm. The fingers appeared to penetrated more deeply into the substrate for coupon B, perhaps because of additional growth during the siliconizing treatment at the higher temperature (700° C. for Run B vs. 625° C. for Run A). A layer about 1 μm thick at the surface of coupon A, which was separated from the coating by a crack, was apparently the elemental Si overlay. A fairly dense but poorly adherent layer about 2–3 μm thick on coupon B was apparently the FeSi layer. The boride layers showed very little lateral cracking and only a few areas experienced pullout during polishing.

Figure 8:
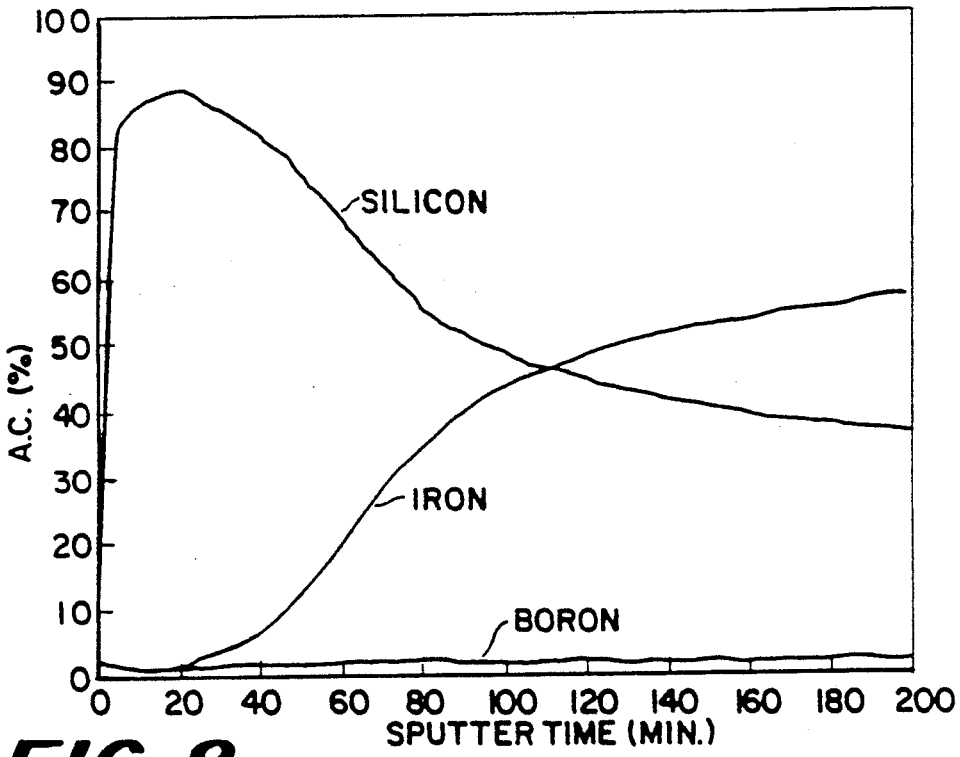

One of the coupons borosiliconized to give a low B:Si ratio (Run D, 0.28 mg B/cm$^2$, 0.74 mg Si/cm$^2$) was analyzed using AES depth profiling with a sputter rate of 9 nm/min. The coupon was both boronized and siliconized at 700° C. FIG. 8 displays the depth profile, which shows that coupon D had an elemental Si overlay of about 0.35 μm and a thick iron silicide with an Fe:Si ratio that varied from about 1:1 beneath the overlay to a ratio of 1.7:1 at a depth of 2.8 μm. Although the boride layer was not reached after sputtering for 320 min, B was observed in a survey scan taken after 780 min of sputtering (7 μm). Thus although the depth profile doesn't give the whole picture of the coating on this coupon, it shows that silicide layers between 3 and 7 μm thick can be formed at 700° C. over borided steel surfaces by treatment with with $SiH_4/H_2$.

The coupons were also cross-sectioned and analyzed using SEM/EDS, forming digital X-ray intensity maps and a secondary electron image. The silicide region appeared as a thick, dense region averaging about 3 μm in thickness. However, portions were very thin, and in a few places cracks extended through the silicide. The X-ray map for Si suggested that the Si concentration was higher near the surface (probably FeSi) than near the crack (probably $Fe_3Si$). Beneath the silicide was a 5 μm boride region with densely packed acicular growths that had experienced pullout during polishing. The less dense boride region contained fingers penetrating up to an additional 2 to 3 μm. Thus the presence of a surface boride layer promoted the formation of a dense silicide layer when the coupon was siliconized with 0.1% $SiH_4/H_2$ at 700° C. Although cross-sectioning pulled out the underlying boride layer when it was prepared at 700° C., surface boride layers remained more intact when they were formed at 850° C. This was confirmed by analysis of the oxidized treated coupons of Example 3.

In summary, this example demonstrated that consecutive treatments of $BCl_3$ and $SiH_4/H_2$ gave diffusion zones of both B and Si. Unexpectedly, the presence of a surface boride layer promoted the formation of a dense silicide layer when the coupon was treated with $SiH_4/H_2$.

EXAMPLE 3

Figure 9:
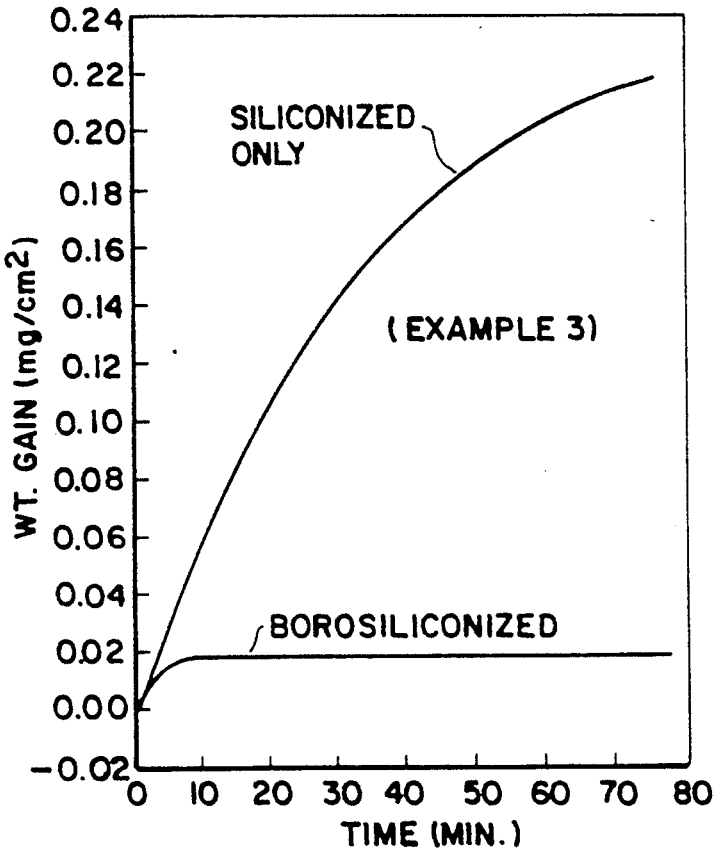
FIG. 9 is a plot of weight gain over time during an oxidation test of treated steel surfaces as described in Example 3.

Coupons of Example 2 treated to produce low B:Si ratios in the coating by being siliconized in 0.1% $SiH_4/H_2$ at 700° C. to deposit 0.73 mg Si/cm$^2$ (after boronizing at 850° C. to deposit 0.25 mg B/cm$^2$) were compared to siliconized-only coupons. A coupon of Example 2, Run F borosiliconized in this way was heated in air to 650° C. in the in situ microbalance system. FIG. 9 shows a comparison of the weight gain vs. time for oxidation of this coupon to the weight gain vs.

time for a siliconized-only coupon (siliconized in the same manner and to the same Si level). The plot begins at the point where the coupon first began to gain weight, which was about 500° C. The siliconized-only coupon, although a substantial improvement over untreated steel, still gains about 0.2 mg/cm$^2$ as a result of oxidation over about 1 hour. The borosiliconized coupon performed almost an order of magnitude better. It gained at most 0.02 to 0.03 mg/cm$^2$ of oxygen during the same time period.

Figure 10:
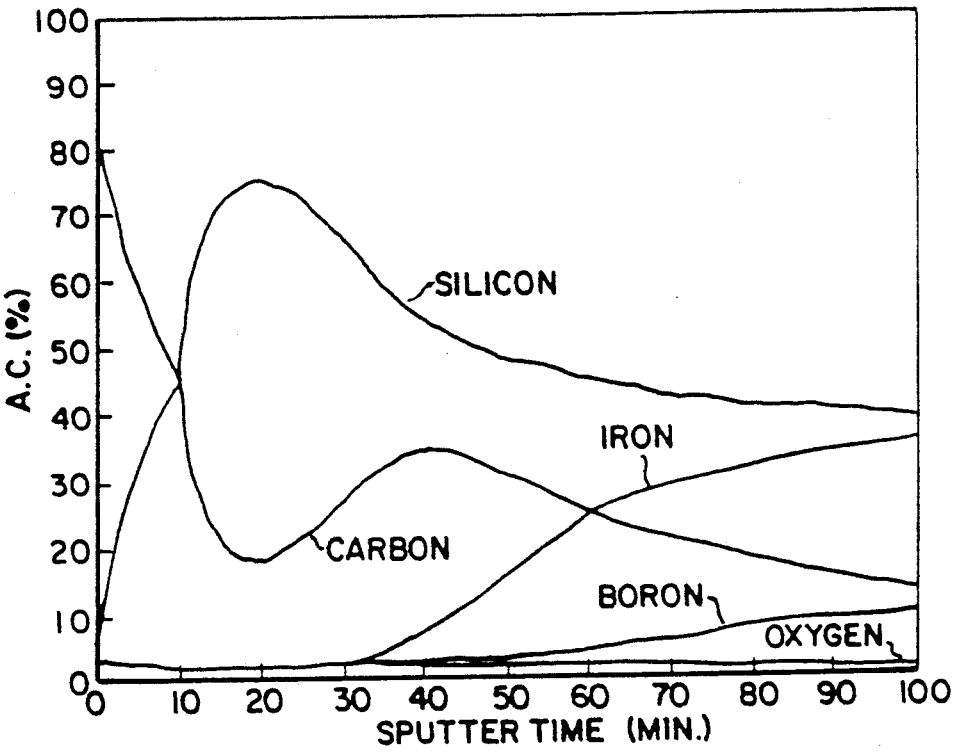
FIG. 10 is an AES depth profile of the composition of the oxidized borosiliconized steel surface described in Example 3.

The oxidized borosiliconized coupon was cut in half using the procedure described in Example 2 and analyzed with AES depth profiling using a sputter rate of 2 nm/min for the first 10 minutes and 9 nm/min thereafter. FIG. 10 shows the depth profile. There was an iron silicide with an FE:Si ratio of slightly less than 1 to the depth profiled, 0.8 μm. Although there was no B present at the Si/iron silicide interface, the B concentration gradually increased to about 10 atom % at a depth of 0.8 μm. There was more B in the iron silicide than for the coupon of Example 2, Run D, which was also siliconized at 700° C. to gain about 0.74 mg Si/cm$^2$, but was boronized at a lower temperature, 700° C. There was an elemental Si overlay, about 0.3 μm thick over the iron silicide. The surface oxide film was not observed, presumably a combined effect of the large amount of carbon present on the surface from the cutting oil and a very thin oxide layer. The presence of carbon from the cutting oil suggests the coating was porous, particularly the elemental Si overlay.

The coupon was also cross-sectioned and analyzed using SEM/EDS, forming a secondary electron image (SEI) of the coating in cross section, and elemental maps for B, Si, O, and Fe. There was a dense, silicide layer without any cracks with a fairly uniform thickness of about 2 μm. Although the dense boride layer, about 7 μm thick, had experienced pullout, it was more intact than the layer on the coupon boronized at 700° C. (Example 2, Run D). The boride fingers extended another 3 μm into the substrate. A strong oxygen signal came from viewing the coupon at an angle. This also made the Si map look less uniform than the silicide region in the SEI. Iron appeared depleted in the coating compared to the substrate. The B map did not show the borided region, probably as a result of the poor sensitivity of EDS for B.

Thus AES depth profiling showed that there was boron in the iron silicide layer. SEM/EDS analysis of the cross section showed that the underlying silicide was dense without any cracks and with a fairly uniform thickness. There was no evidence of oxidation of the underlying Fe substrate as observed for siliconized-only coupons that were oxidized under the same conditions. Although the portion of the underlying boride layer with densely packed acicular growths had experienced pullout, it was more intact than the boride layer on the coupon boronized at 700° C. Thus boronizing at 850° C. and siliconizing at 700° C. seems to have given the best distribution of elements in the coatings of the treatments illustrated.

In summary, this example demonstrates the utility of this invention for providing oxidation resistance to ferrous metals. More importantly, it describes a unique and unexpected result: the oxidation rate of borosiliconized steel was an order of magnitude lower than the oxidation rate of a siliconized-only steel. In addition, this example demonstrates an improvement in the integrity of the boride layer when it was formed at 850° C. rather than 700° C.

While we are not to be bound by theory, it is believed that ferrous metal surfaces which are treated to obtain a silicon diffusion coating only and then oxidized at 650° C. or higher, experience the formation of iron oxide at the coating substrate interface. Silicon dioxide forms at the surface, but it appears to be so thin that it does not contribute to the weight gain and cracks in the silicide coating provide a route by which oxygen can attack the substrate. We have found that a borided surface promotes the formation of a dense, crack-free silicide when the ferrous metal is siliconized in $SiH_4/H_2$. Also, if cracks are present in the silicide, $B_2O_3$ formation when the treated metal surface is exposed to oxygen provides a fluxing action which promotes the formation of a protective oxide layer.

Other advantages and embodiments of our invention will be apparent to those skilled in the art from the foregoing disclosure without departing from the spirit or scope of our invention.

We claim:

1. A method of improving the surface properties of a structure formed from iron or a ferrous alloy which comprises subjecting the surface of said structure to a stream of reducing carrier gas comprising hydrogen to which a gaseous hydride compound of each of silicon and boron have been added together at an elevated temperature below 1200° C. for a time sufficient to diffuse both silicon and boron into said surface.

2. The method of claim 1 wherein said surface is pretreated at 400° to 1200° C. with a reducing atmosphere containing hydrogen under conditions controlled to reduce any oxide film present on said surface.

3. The method of claim 2 wherein said pretreatment step is conducted under an atmosphere of hydrogen wherein the molar ratio of oxygen to hydrogen is less than $2\times10^{-4}$.

4. The method of claim 1 wherein said carrier gas includes inert gas.

5. The method of claim 2 wherein said silicon compound has been added as $SiH_4$ and said boron compound has been added as $B_2H_6$.

* * * * *